US010315810B2

(12) United States Patent
Wichowski

(10) Patent No.: US 10,315,810 B2
(45) Date of Patent: Jun. 11, 2019

(54) BOX

(71) Applicant: Hoffmann Neopac AG, Thun (CH)

(72) Inventor: Artur Wichowski, Lohn-Ammannsegg (CH)

(73) Assignee: Hoffmann Neopac AG, Thun (CH)

( * ) Notice: Subject to any disclaimer, the term of this patent is extended or adjusted under 35 U.S.C. 154(b) by 57 days.

(21) Appl. No.: 15/511,881

(22) PCT Filed: Sep. 11, 2015

(86) PCT No.: PCT/CH2015/000132

§ 371 (c)(1),
(2) Date: Mar. 16, 2017

(87) PCT Pub. No.: WO2016/041094

PCT Pub. Date: Mar. 24, 2016

(65) Prior Publication Data

US 2017/0253391 A1 Sep. 7, 2017

(30) Foreign Application Priority Data

Sep. 16, 2014 (CH) ..... 01394/14

(51) Int. Cl.

| | |
|---|---|
| ***B65D 43/16*** | (2006.01) |
| ***A45C 13/00*** | (2006.01) |
| ***A45D 33/00*** | (2006.01) |

(52) U.S. Cl.

CPC ..... *B65D 43/16* (2013.01); *A45C 13/008* (2013.01); *A45D 33/006* (2013.01); *A45D 2200/051* (2013.01)

(58) Field of Classification Search

USPC ..... 220/829, 830

See application file for complete search history.

(56) References Cited

U.S. PATENT DOCUMENTS

| | | | | |
|---|---|---|---|---|
| 1,438,376 | A * | 12/1922 | Jeanmaire | A01J 9/06 220/314 |
| 2,052,826 | A * | 9/1936 | Handschur | B65D 45/08 190/28 |
| 5,988,185 | A | 11/1999 | Gueret | |
| 2002/0014434 | A1 | 2/2002 | Mathiez | |
| 2013/0161345 | A1 * | 6/2013 | Tatin | A45D 40/0068 220/830 |
| 2013/0334230 | A1 | 12/2013 | Delage et al. | |

FOREIGN PATENT DOCUMENTS

| | | |
|---|---|---|
| EP | 0836817 | 4/1998 |
| FR | 2786075 | 5/2000 |
| FR | 2969127 | 6/2012 |
| WO | 2011154509 | 12/2011 |

* cited by examiner

*Primary Examiner* — Andrew T Kirsch
*Assistant Examiner* — Don M Anderson
(74) *Attorney, Agent, or Firm* — Volpe and Koenig, P.C.

(57) ABSTRACT

A box (1) is provided including a lower part (3), acting as a container, and a lid (5). A plate (23) which can be moved with play is inserted into the lid (5). This plate (23) is resiliently supported on the inner side of the lid (5). When closing the box (1), the plate (23) moves into contact with the upper edge (13) of the lower part (3) and seals the inside of lower part (3) with respect to the surroundings.

9 Claims, 1 Drawing Sheet

BOX

BACKGROUND

The invention relates to a box comprising a lower part, serving as a container, and a lid for closing the container in accordance with the preamble of patent claim 1.

Boxes of this generic type are known. In most of these boxes, the lids are hinged; the remainder are of the plug-on type and can be temporarily latched with the lower part of the box by suitable latching means. Particularly with respect to boxes that have hinged, that is to say pivotable, lids, the interior of the lower part serving as a container cannot be readily sealed, with the result that moisture-sensitive contents cannot be optimally protected against the ingress of moisture or extraneous odors. In the case of hinged lids, sealing compounds which are inserted or injected into the lid rest non-uniformly on the edge of the container and can therefore not be used as a seal.

SUMMARY

An object of the present invention includes providing a box having a hinged or plugged-on lid which has a seal which optimally seals the interior of the lower part and prevents the ingress of air, moisture and extraneous odors.

This object is achieved by a box in accordance with one or more features of the invention. Advantageous embodiments of the box are outlined below and in the claims.

In the case of boxes with a lid which can be plugged on, and particularly even in the case of boxes with a lid that is hinged to the lower part, an optimal tight closure can be achieved by means of a plate which spans the entire opening of the lower part and rests with full-surface contact on the upper edge of the lower part and also by means of a spring element which presses the plate uniformly onto the lower part. The sealing effect is enhanced by a sealing region which extends at an acute angle to the central region of the plate. The spring elements mounted on the upper side of the plate are supported on the underside of the lid and permanently press the plate uniformly onto the lower part. The spring elements used are elastic flaps or spring elements projecting from the upper side of the plate. Alternatively, a foam element interposed between lid and plate can also serve as a spring. The flaps and/or the plate can be made of metal, in particular resilient metal, or plastic. In a particularly advantageous embodiment of the invention, the underside of the plate is coated with a film, which additionally enhances the sealing effect on the upper edge of the lower part. The plate is dimensioned in such a way that it can be inserted toollessly into the lid of the box and latch therein after insertion. Optimum sealing between a lid that is hinged on the lower part and the lower part can also be achieved by the plate even if the lid does not come to lie parallel to the edge on the lower part due to large dimensional tolerances.

BRIEF DESCRIPTION OF THE DRAWINGS

The invention is explained in more detail with reference to an illustrated exemplary embodiment. In the drawings.

DETAILED DESCRIPTION OF THE PREFERRED EMBODIMENTS

Figures 1, 2, 3, 4, 5, 6, 7, 8, 9, 10:
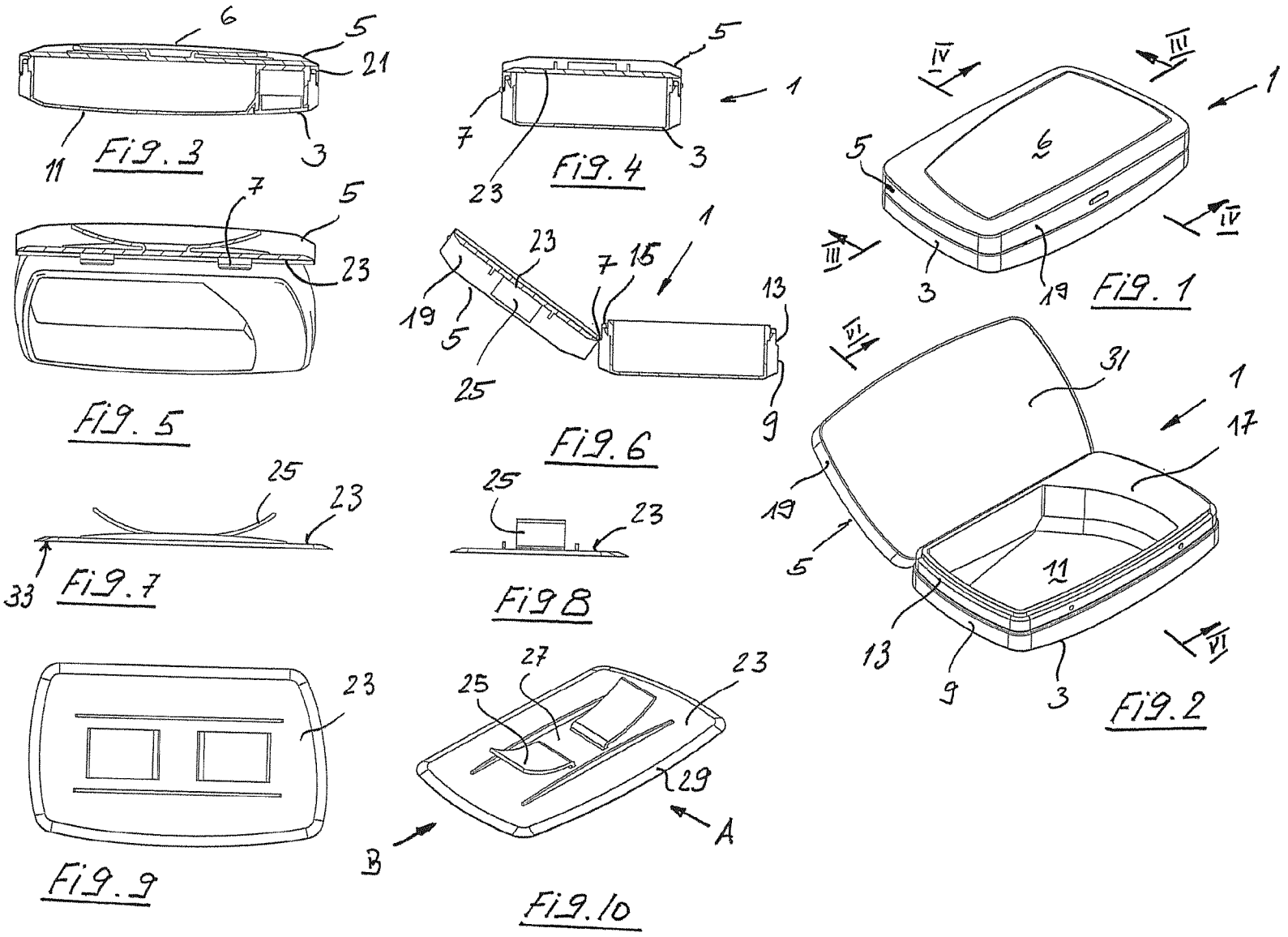
FIG. 1 shows a perspective view of a closed box.
FIG. 2 shows a perspective view of the box according to FIG. 1 with an opened lid.
FIG. 3 shows a cross section through the box along line III-III in FIG. 1.
FIG. 4 shows a cross section through the box along line IV-IV in FIG. 1.
FIG. 5 shows an illustration of the partially opened lid from above.
FIG. 6 shows a cross section through the box along line VI-VI in FIG. 2.
FIG. 7 shows a side view of the sealing plate from the direction of arrow A in FIG. 10.
FIG. 8 shows a side view of the sealing plate from the direction of arrow B in FIG. 10.
FIG. 9 shows a plan view of the sealing plate.
FIG. 10 shows a perspective plan view of the sealing plate.

The box designated by reference sign 1 comprises a lower part 3, serving as a container or contents receptacle, and a lid 5. In the present example, the lid 5 is pivotably connected to the lower part 3 by a hinge 7. The hinge 7 is designed in a conventionally known way and is therefore not described in further detail. Alternatively, the lid 1 can also be designed such that it is only able to be plugged on and such that it can be latched by means of protuberances on the lower part (no figure).

The lower part 3 comprises at the top a peripheral edge 9 which is of stepped design in the present example, i.e. the region of the peripheral container wall situated deeper and closer to the bottom 11 is larger in cross section than the region directed toward the upper edge 9. The upper edge 9, which delimits the opening cross section of the lower part 3, is terminated by an inwardly or outwardly directed curled flange 15. It can additionally be seen from FIGS. 2-6 that an insert 17, for example an insert made of plastic, can be placed in the lower part 3, if such an insert is required. The lid 5 comprises a peripheral lid edge 19 which, with the lid 5 closed, peripherally encloses the upper part of the lower part 3. A peripheral, inwardly directed flange 21 is formed on the free edge of the lid 5. The flange 21 serves, on the one hand, to move the sharp sheet metal edge of the lid 5 out of the grip region and, on the other hand, the flange 21 serves to fix a plate 23 in a freely movable manner within the lid 5, i.e. between the lid surface and the flange 21, or to prevent the plate 23 from falling out of the lid 5. The contour or the outer edge of the plate 23 corresponds to the contour of the edge 19 of the lid 5. Accordingly, the plate 23 is situated with slight play above the flange 21 within the lid 5 and is prevented in this position, between the inner side of the lid surface 6 and the flange 21, from falling out by the flange 21. On the upper side of the plate 23 there are formed two tabs 25 which project upwardly from the surface of the plate 23. The tabs 25 are fastened to the plate 23 or, as part thereof, are produced therefrom by a punching and bending operation. In order to increase the elasticity of the tabs 25 or the spring effect thereof, the latter can also be arranged on a plate portion 27 bent out of the plate 23 (FIGS. 9 and 10). The peripheral edge region 29 of the plate 23 is preferably formed at an acute angle, thus extending in a roof-shaped manner with respect to the plate surface. The roof-shaped region on the periphery of the plate 23 serves for centering the plate 23 on the lower part. The plate 23 can be configured to be planar or slightly domed in its center.

In the case of a plate 23 in which the flaps 25 are produced from the plate 23 by a punching/bending operation, a film 31 for covering the apertures formed when punching out the flaps 25 is arranged on the underside of the plate 23, preferably being adhesively bonded to the plate 23. The film 31 is advantageously produced from a soft material and extends into the edge region 29 of the plate 23. Consequently, beside the function of overlapping the apertures generated when punching out the flaps 25, the film 31 also functions in the edge region 29 as an elastic seal if the lid 5 is closed. Alternatively, instead of the flaps 25, foam can be adhesively bonded to the upper side of the plate 23 and serve as a seal and as a spring.

On closing the lid 5, the plate 23 comes uniformly all the way around into tight contact with the edge 9 on the upper edge of the lower part 3 along the opening of the lower part 3. This occurs irrespective of whether the lid 5 thus lies exactly parallel to the lower part 3 or not. The sprung arrangement of the plate 23 in the lid 5 always ensures uniform pressing of the plate 23 onto the lower part 3. The elastic and "floating" mounting of the plate 23 is obtained by the free edges of the elastic flaps 25 or the foam making contact with and being supported on the inner side of the lid surface 6 of the lid 5.

Of course, instead of or in addition to the film 31, the edge region 29 of the plate 23 can be coated with a sealing compound 33 which compensates for any unevenness which may be present along the upper edge 9 of the lower part 3 or on the plate 23 itself.

The invention claimed is:

1. A box (1) comprising a lower part (3), which serves as a container, a lid (5) for closing the lower part (3), and a sealing element which is arranged on the lid (5), is adapted to rest on a free upper edge (9) of the lower part (3) with the lid (5) closed and is provided for tightly closing off an interior of the lower part (3) with respect to the surroundings, the sealing element comprises a plate (23) which spans an opening cross section at the upper edge (9) of the lower part (3), a profile of an edge region (29) of the plate (23) corresponds to a profile of the upper edge (9) of the lower part (3), a spring element (25) is arranged on the plate (23) and projects from an upper side thereof, the spring element comprises spring-elastic tabs (25) which project from the upper side of the plate (23) and which are connected to the plate (23) or are Part of the plate (23), or the spring element is formed as a foam part applied to the plate (23), and the plate (23) is formed of metal or partly of metal and partly of plastic.

2. The box as claimed in claim 1, wherein the plate (23) is dimensioned to be insertable from below into the lid (5) and is held therein with play after insertion between a flange (21) on a lower edge (19) of the lid (5) and an inner side of the lid (5).

3. The box as claimed in claim 1, wherein the edge region (29) of the plate (23) extends at an acute angle to a central planar or domed region of the plate (23).

4. The box as claimed in claim 1, wherein a sealing compound (33) is arranged on the edge region (29) at an underside thereof.

5. The box as claimed in claim 1, wherein the spring element (25) is at least one of formed or arranged as part of the plate (23) on the upper side of the plate (23).

6. The box as claimed in claim 1, further comprising a film (31) which at least one of covers or overlaps a cross section of the plate (23) is mounted on the underside of said plate.

7. The box as claimed in claim 1, wherein the lid (5) and the lower part (3) are connected to one another by a hinge (7).

8. The box as claimed in claim 1, the lid (5) and the lower part (3) are connectable to one another by being able to be plugged onto one another.

9. The box as claimed in claim 1, wherein the spring element (25) is arranged in a central area of the plate.

* * * * *